US005921706A

United States Patent [19]

Manatt et al.

[11] Patent Number: 5,921,706

[45] Date of Patent: Jul. 13, 1999

[54] METHOD AND MEANS FOR ON-ROADWAY RECYCLING OF PAVEMENT AND RECOVERING STEELS THEREFROM

[75] Inventors: Michael J. Manatt, Brooklyn, Iowa; James A. Duit, Edmond, Okla.; Anthony J. Manatt, DeWitt, Iowa; Steven J. Rhoads, Brooklyn, Iowa; Steven C. Yerington, Tipton, Iowa

[73] Assignees: Manatts, Inc., Brooklyn, Iowa; a part interest; Duit Construction Co., Inc., Edmond, Okla.; a part interest

[21] Appl. No.: 08/971,479

[22] Filed: Nov. 15, 1997

Related U.S. Application Data

[60] Division of application No. 08/546,197, Oct. 20, 1995, Pat. No. 5,762,446, which is a continuation-in-part of application No. 08/178,647, Jan. 7, 1994, abandoned.

[51] Int. Cl.[6] ..... E01C 23/12

[52] U.S. Cl. ..... 404/72; 404/75; 404/90

[58] Field of Search ..... 404/72, 75, 84.05, 404/84.1, 90, 91, 92; 299/10, 36, 37, 39; 241/101.7; 280/6.1, 6.12, 840, DIG. 1

[56] References Cited

U.S. PATENT DOCUMENTS

| | | | |
|---|---|---|---|
| 1,354,076 | 9/1920 | Stephens . | |
| 2,768,794 | 10/1956 | Putnum . | |
| 3,510,073 | 5/1970 | Mailliard . | |
| 3,841,570 | 10/1974 | Quinn | 241/101.7 |
| 3,940,163 | 2/1976 | Davis et al. | 280/840 |

(List continued on next page.)

FOREIGN PATENT DOCUMENTS

| | | | |
|---|---|---|---|
| 31787 | 7/1981 | European Pat. Off. | 241/79.1 |
| 155068 | 9/1992 | Japan . | |
| 359194 | 5/1993 | Japan . | |

OTHER PUBLICATIONS

English Abstract, JP 04–359194, May 11, 1993, Kanjiro Ishizaki, et al.

English Abstract, JP 04–155068, Sep. 17, 1992, Kanichiro Nakazawa.

*Tecweigh™ Conveyor Belt Scales: Weigh the Advantages,* Tecnetics Industries, Inc., St. Paul, Minnesota, Prior to Jan. 7, 1994.

*Conveyor Belt Scales,* Weigh–Tronics, Inc., Fairmont, Minnesota, Apr. 1991.

*Primary Examiner*—James A. Lisehora

*Attorney, Agent, or Firm*—Zarley, McKee, Thomte, Voorhees & Sease

[57] ABSTRACT

Apparatus and methods for recycling concrete pavement in a coordinated procession include a breaker which turns the concrete into rubble first backhoe which rips up and cuts the concrete to rubble chunks, then another backhoe loads the chunks into a self-propelled crusher. If the concrete is reinforced with metallic structures, the first backhoe cuts those along with the concrete. The crusher separates the concrete from any steel and fines in the rubble. The crusher discharges the steels in collection bins mounted thereon. Various bins and ways of dumping them are disclosed. The crushed concrete is discharged to the roadway as multi-gradated aggregate. The crusher can also be made self-leveling by a slope control, slope sensors, and hydraulic cylinders arranged thereon in a closed loop feedback circuit. Based on slope control commands, the cylinders individually raise or lower the plurality of crawler tracks that support the crusher so the crusher can automatically maintain a level attitude while at rest or on-the-go. Various methods of recycling are presented based upon the inclusion and positioning of the equipment, their discharge conveyors, and the number of lanes of pavement broken up in one pass.

1 Claim, 11 Drawing Sheets

U.S. PATENT DOCUMENTS

| | | | |
|---|---|---|---|
| 3,977,039 | 8/1976 | Brock | 15/346 |
| 4,309,126 | 1/1982 | Pfaff . | |
| 4,545,700 | 10/1985 | Yates . | |
| 4,560,207 | 12/1985 | Eftefield et al. . | |
| 4,585,179 | 4/1986 | Tsuji et al. | 241/101.7 |
| 4,635,386 | 1/1987 | Kobayashi | 299/36 |
| 4,676,688 | 6/1987 | Caradot | 404/91 |
| 4,692,058 | 9/1987 | Mengel . | |
| 4,722,636 | 2/1988 | Brock | 404/84.1 |
| 4,903,903 | 2/1990 | Benen | 241/101.7 |
| 5,026,205 | 6/1991 | Gorski et al. | 404/72 |
| 5,026,206 | 6/1991 | O'Connor . | |
| 5,028,170 | 7/1991 | Gorski et al. | 404/90 |
| 5,054,958 | 10/1991 | Strunk | 404/91 |
| 5,178,484 | 1/1993 | Strunk . | |
| 5,292,079 | 3/1994 | Zakohji | 241/101.7 |
| 5,460,332 | 10/1995 | Frick | 241/101.74 |
| 5,476,227 | 12/1995 | Tamura et al. | 241/101.74 |
| 5,580,004 | 12/1996 | Tamura et al. | 241/101.74 |
| 5,762,446 | 6/1998 | Manatt et al. | 404/75 |

WATER TANKER
STEEL COLLECTION BINS
SECONDARY CRUSHER AND DR SCREENING UNIT
FINES
SUBGRADE TRIMMER
LAND LEVELER
PRIMARY CRUSHER
LOADING BACKHOE
BACKHOE (RIPPER)
BREAKER
SHOULDER REMOVAL MEANS
WATER TANKER
BREAKER
SHOULDER REMOVAL MEANS
BACKHOE (RIPPER)

PRIMARY CRUSHER
LOADING BACKHOE
SUBGRADE TRIMMER
SECONDARY CRUSHER AND OR SCREENING UNIT
FINES
LAND LEVELER
10
12
14
16
18
22
28
30
36
37
38
41
42
112

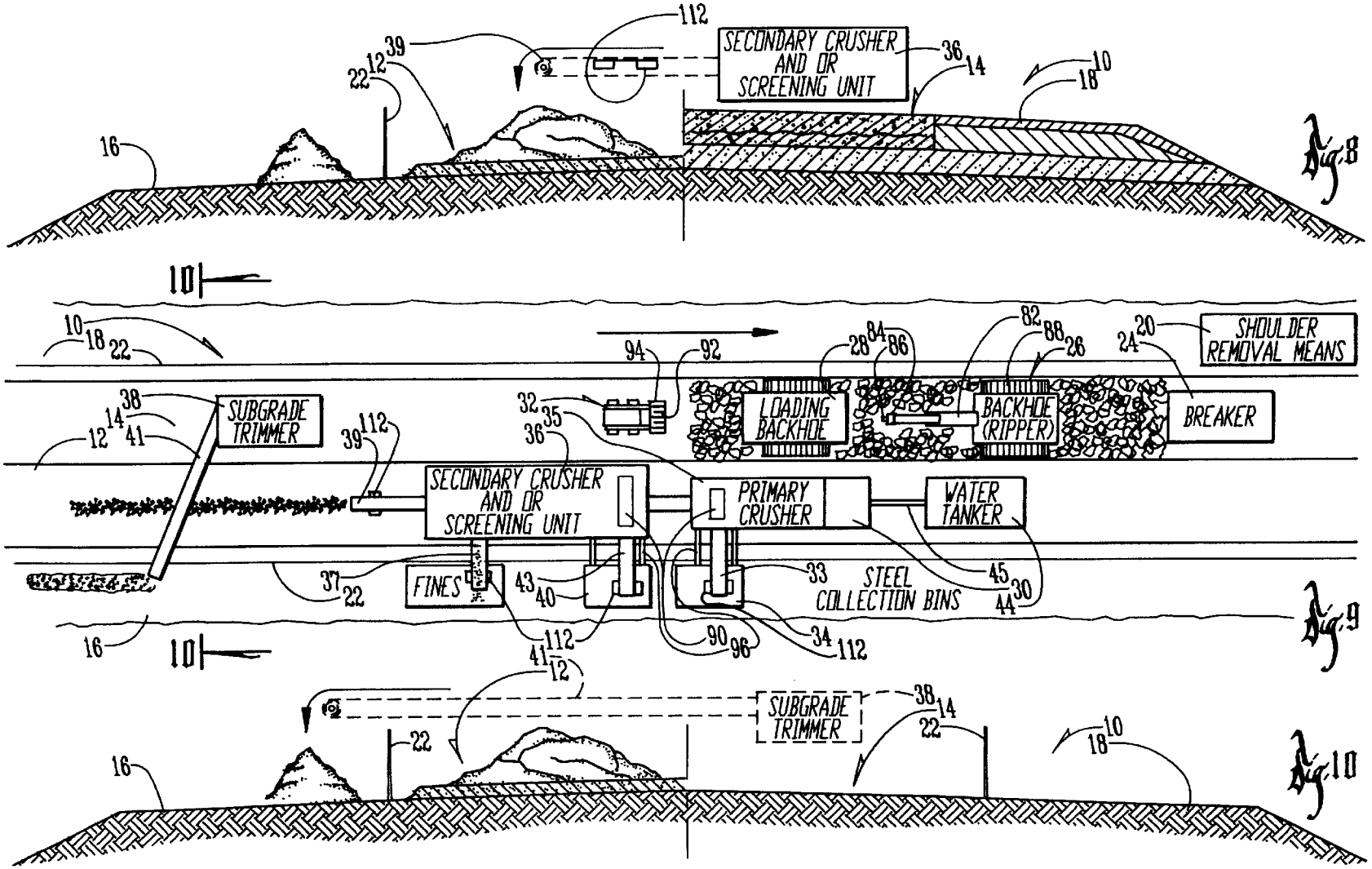
SECONDARY CRUSHER AND OR SCREENING UNIT
SHOULDER REMOVAL MEANS
BREAKER
BACKHOE (RIPPER)
LOADING BACKHOE
WATER TANKER
PRIMARY CRUSHER
STEEL COLLECTION BINS
SECONDARY CRUSHER AND OR SCREENING UNIT
FINES
SUBGRADE TRIMMER
SUBGRADE TRIMMER

METHOD AND MEANS FOR ON-ROADWAY RECYCLING OF PAVEMENT AND RECOVERING STEELS THEREFROM

CROSS-REFERENCE TO RELATED APPLICATIONS

This is a divisional of application Ser. No. 08/546,197 filed on Oct. 20, 1995 now U.S. Pat. No. 5,762,446, which is a continuation-in-part of Ser. No. 08/178,647 filed on Jan. 7, 1994, now abandoned.

BACKGROUND OF THE INVENTION

This invention relates to apparatus and methods for continuously breaking up, removing, and recycling pavement on the roadway. More particularly, this invention relates to a system of recycling the existing pavement on a roadway so as to allow the almost immediate reuse of the resulting multi-gradated aggregate products thereof as a granular subbase over which replacement pavement can be laid. Of course, multi-gradated aggregate products can be put to many uses other than being granular subbase for a section of pavement.

It should be understood that the apparatus and methods described herein could also relate to mobile quarrying applications where the products are stockpiled rather than immediately reused. Rock crushing machines have been used in quarrying operations for some time. Typically, these quarry-based machines have very limited mobility and cannot be efficiently leveled with respect to the terrain. As crushers with greater mobility have been developed, some users have tried to level them by manually adjusting the pressure in the tires supporting the crusher. However, this is time consuming and often impractical when the terrain changes quickly. The crusher can only progress haltingly.

The term multi-gradated aggregate products, as used herein, should be understood to include concrete stone, aggregate, sand, dirt, and other materials found in concrete pavement. The subset of multi-gradated aggregate products which is allowed by specification to be used as subbase under highway pavement is referred to in the art as granular subbase.

Highways, air fields, and many other structures designed for travel are constructed of pavement. Because of its high compressive strength, Portland cement concrete (PCC) is often used in paving. Asphaltic cement concrete (ACC) is also a popular choice. However, the relatively poor tensile strength of these materials often forces designers to specify that reinforcing metallic structures such as steel bars, dowel rods, CD baskets, or mesh extend through the regions of greatest tensile stress. Properly constructed steel reinforced concrete is stronger and less bulky than the nonreinforced variety. On the other hand, many concrete pavements and structures are suitably constructed using little or no steel reinforcement.

Inevitably, time and various forces wear on the structures and even steel reinforced concrete deteriorates, necessitating replacement. Changing public needs often demand the replacement of pavement, regardless of its condition. For example, highways and the like frequently need to be widened or fortified for heavier use.

The composition of a paved roadbed can vary greatly depending on ground conditions and local construction standards. However, a typical pavement surface is comprised of layers. Of course, the upper layer of concrete, PCC or ACC, is most noticeable. The concrete itself is comprised of cement, fine and coarse aggregate, and water. A layer of subbase, such as sand or other fines, is often placed immediately below the concrete. This layer is known as bottom lift. Steel reinforcing bars, dowel rods, CD baskets, or meshes are set in place and become embedded in the concrete as it is poured. These steel structures are known to provide the poured concrete with additional tensile strength. Sometimes the concrete is poured over whatever underlying surface is present, but often a layer of subbase material is placed there first. The subbase material consists of screened or selected multi-gradated aggregate products—usually coarse aggregate, sand, selected fill, asphalt, or concrete. Such a subbase can help spread the load of the concrete slab and provide better drainage thereunder. Underlying the subbase is dirt or other material known as subgrade.

Recently, conservation of natural resources has become a major concern in the construction of concrete highways and the like. Conservation, cost savings, space limitations and regulations have motivated construction companies to search for new ways to reuse existing highway concrete. Landfill regulations in some states and municipalities seriously impinge on contractors' ability to dispose of old concrete which they have removed. Recycling existing concrete highway pavement has been found to reduce costs and save space in the landfills.

Various forms of concrete pavement recycling apparatus and methods exist today. However, they tend to be relatively inefficient, labor intensive, and disruptive of existing traffic. Many conventional methods of pavement recycling require that the broken pavement chunks be transported to a remote site (away from the roadway) for further processing, such as crushing to size and removing and reclaiming the reinforcing steel.

U.S. Pat. No. 5,026,205 to Gorski, issued on Jun. 25, 1991, discloses apparatus and a method for removing, harvesting and recycling pavement. A "train" of equipment is spearheaded by a vehicle having a wedge for prying the concrete up from the ground. While it is suspended, the concrete slab is broken up by blows from two hydraulic hammers pivotally mounted overhead.

This wedge and hammer arrangement breaks up the concrete and jars it loose from the steel reinforcements, but a wedge-accommodating hole in the lane of pavement is required to begin the systematic removal. It takes a great deal of horsepower for this arrangement to plow up the concrete and process it. Since this method is dependent on the train of equipment having good traction on the ground after the concrete has been removed, rainy or muddy conditions can halt or slow the process. Considerable adjustment is also necessary because the size and angle of the wedge must be selected. Furthermore, the angle and pivoting action of the hammers must be adjusted and set.

The Gorski process operates in a rigidly linear fashion to harvest and recycle a single lane of pavement at one time. It is not very flexible. The train of the Gorski reference lacks a trimmer for the simultaneous final grading of the ground to elevation when required. Undesirable fluctuation of the subgrade can result in faults developing later in the concrete.

Furthermore, Gorski fails to disclose efficient means for handling the metallic reinforcing structures (usually steels) that are often present in reinforced concrete pavement. Gorski suggests that a truck 500 can move on the shoulder alongside the crusher to receive any steels discharged. This is impractical if the shoulder is narrow or conditions are muddy. Furthermore, an extra operator is required to drive the truck.

A need exists for apparatus and methods that can, in a single pass and without undue preparation, rapidly, flexibly, and economically remove and recycle an existing lane of pavement. Preferably the system separates the steel and concrete components and renders them into small pieces which are easier to handle and recycle. Ideally, the concrete is rendered into multi-gradated aggregate products. One possible use of these products is to provide a granular subbase which is immediately used as a base for replacement pavement.

Therefore, it is an object of this invention to provide apparatus and methods for continually, rapidly, flexibly and economically breaking up a lane of existing concrete pavement and recycling the same for immediate use in replacement paving.

It is a further and subsequent object of this invention to immediately, rapidly, flexibly, and economically process concrete (and separate the steel when the concrete is steel reinforced) and render the concrete into smaller pieces known as multi-gradated aggregate products which are immediately available for reuse, especially as granular subbase.

It is a further object of this invention to conserve construction materials and avoid waste by recycling existing concrete pavement into material ready for subsequent and even immediate use in repavement.

It is a further object of this invention to provide apparatus and methods whereby the trimming of the subgrade is optionally integrated into the process for recycling concrete into granular subbase and is thereby done simultaneously if desired.

It is a further object of this invention to provide methods which are less likely to be forced to shutdown due to muddy conditions.

It is a further object of this invention to provide apparatus which crushes concrete to coarse aggregate size, removes the steels from the same, trims the subgrade to elevation and places the resulting coarse aggregate on site.

It is a further object of this invention to provide a self-leveling crusher that maintains its crushing means in a level attitude while traversing the roadway.

It is a further object of this invention to provide apparatus and methods which quickly recycles and replaces existing road surfaces.

SUMMARY OF THE INVENTION

The present invention includes methods and apparatus for continuous, on-grade (roadway), self-propelled, recycling of a concrete pavement slab. The apparatus includes a conventional breaker for breaking concrete pavement into rubble. Subsequently included are mobile means for excavating and cutting the resulting rubble into smaller chunks, a self-propelled, and optionally self-leveling, crusher for reducing the rubble into pieces, a loading device for feeding the rubble chunks into the crusher, and pivotable discharge means for unloading from the crusher the resulting multi-gradated aggregate products which are suitable for many construction uses, including use as granular subbase for repaving. A water tanker or similar conventional means for controlling dust accompanies the crusher during crushing. The fluid therefrom also prewets the concrete rubble pieces and/or fines in the crusher so that they do not generate dust upon discharge. The crushing can be accomplished in one stage when the crusher is operatively connected to a screening unit wherein oversized rubble pieces are rerouted to the crusher and reprocessed, or in two stages by interconnected primary and secondary crushers.

The present invention also includes a paradigm of methods for mobile, on-site, on-grade recycling of one or more lanes of concrete pavement having top and bottom surfaces with a subgrade and potentially a subbase under the bottom surface, including positioning the equipment, advancing the equipment while breaking the concrete with the breaker, ripping and cutting the resulting rubble (and any reinforcing steel present) with a ripping backhoe, loading the resulting rubble chunks into the crusher and exposing the subgrade with a backhoe and a skid steer loader having a rake bucket, crushing the rubble pieces and controlling any dust generated thereby with conventional means, such as water supplied by a tanker propelled by and connected with the crusher, separating out the products of the crusher (multi-gradated aggregate products, especially materials suitable for granular subbase, fine materials, and any metallic materials such as steel), and discharging them via pivotable conveyors to convenient locations for selective use in nearly immediate repavement in the wake of the recycling process.

Various configurations for recycling one or more lanes are achieved by altering the position of the breaker, the crusher and its pivotable discharge conveyors, and the subgrade trimmer and its discharges.

The present invention includes a self-leveling crusher which utilizes a slope control, slope or levelness sensors, and hydraulic cylinders arranged in a closed loop feedback circuit. Based on commands from the slope control, the cylinders individually raise or lower the plurality of crawler tracks that support the crusher. Thus, the crusher can automatically maintain a level attitude while traversing the roadway and crushing the pavement thereon.

BRIEF DESCRIPTION OF THE DRAWINGS

FIG. 8 is a cross sectional view of the pavement, taken along line 8—8 in FIG. 1, which shows the secondary crusher and/or screening unit discharging and depositing the granular subbase on the layer of fines in preparation for replacement paving.

FIG. 9 is a schematic diagram which shows an alternate embodiment of the present invention wherein a second lane is recycled and the resulting granular subbase can be used as additional subbase on an already recycled first lane.

FIG. 10 is a cross sectional view of the roadbed, taken along line 10—10 in FIG. 9, which shows the subgrade trimmer discharging dirt, etc. to the opposite shoulder over the windrow of granular subbase left by the secondary crusher and/or screening unit.

DETAILED DESCRIPTION OF THE PREFERRED EMBODIMENT

Figures 1, 2, 3:
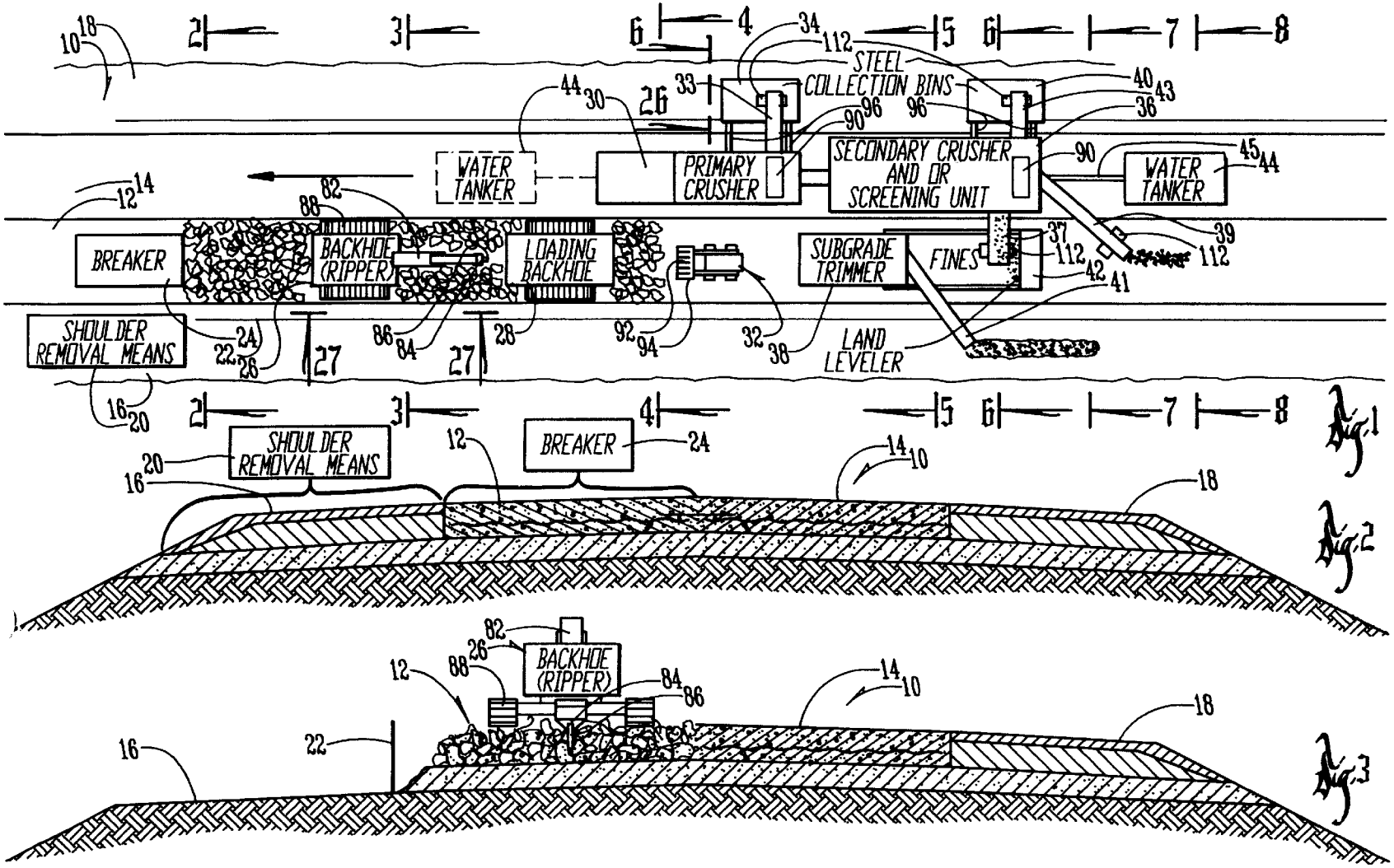
FIG. 1 is a schematic view which shows the method and means of the present invention applied to recycle half the width (inside lane first) of two lanes of pavement.
FIG. 2 is a cross sectional view of the pavement, taken along line 2—2 in FIG. 1, which shows the effects of the shoulder removal means and pavement breaker on the highway surface.
FIG. 3 is a cross sectional view of the pavement taken along line 3—3 in FIG. 1, which shows the effects of the backhoe ripper on the highway.

The method and means for recycling concrete pavement according to the present invention is shown generally in FIG. 1. A portion of two-lane pavement 10 has lanes 12 and 14, and shoulders 16 and 18 respectively. As is usual in highway construction, one or more of the shoulders can be removed by a grader or other shoulder removing means 20. Appropriate stringlines are laid by surveyors. Among them is median stringline 22, which provides guidance for the later discussed trimmer and other equipment during the recycling of lane 12. Of course, other guiding mechanisms such as lasers can also be used. The use of stringlines, guiding mechanisms, and shoulder removal equipment is well known in the construction field and is implied though not specifically discussed hereinafter.

The equipment for recycling pavement is described below in some detail. The first piece of equipment is a conventional concrete breaker 24. A resonant, guillotine, or other type of breaker is suitable so long as the concrete is broken into rubble having at least one dimension less than about eighteen inches. This size rubble has been found to be easiest for the later crushing operation to handle.

FIG. 2 shows the above-mentioned effects of the shoulder removal means and breaker on the pavement. The breaker 24 is driven slowly forward down the lane, in the general direction of the arrow in FIG. 1.

FIG. 3 shows the effects of the backhoe ripper 26 which follows the breaker 24. Backhoe ripper 26 is preferably self-propelled by an engine which drives tracks 88 mounted on its under-carriage. This track-type drive is similar to that commonly found in other construction equipment or on military vehicles such as tanks. The tracks 88 provide greater durability, flexibility and traction for the backhoe ripper 26 to maneuver over and among the rubble. The tracks 88 generally provide better traction in muddy or wet conditions than rubber tires.

The backhoe ripper 26 also has a hydraulically operated boom arm 82 having a ripper attached to the free end thereof. The ripper has a movable finger 86 known as a "rhino horn" and a stationary cutting thumb 84 which operate in one mode as a hinged snipping jaw or cutting shears for snipping the rubble into smaller chunks.

In another mode, the "rhino horn" rips or taps at the rubble to break it up. When the pavement being recycled is reinforced with metallic structures, which are frequently made of steel, the ripper jaw is particularly useful in picking up the interconnected chunks of rubble and separating the steel and/or mesh from the concrete by cutting the former. The separate chunks of rubble are easier for the rest of the equipment to handle and process. As is conventional, any large steel items such as dowel bars excavated by backhoe ripper 26 are sorted out manually because these can damage the later-described recycling equipment.

Any conventional track-driven backhoe having a hydraulic boom equipped with the ripper described above will suffice for the purposes of this invention, but one manufactured by the Link-Belt Construction Equipment Company of Lexington, Ky. under the designation LS-3400 C Series II Hydraulic Excavator is known to perform well for these tasks.

Figures 4, 5, 6, 7:
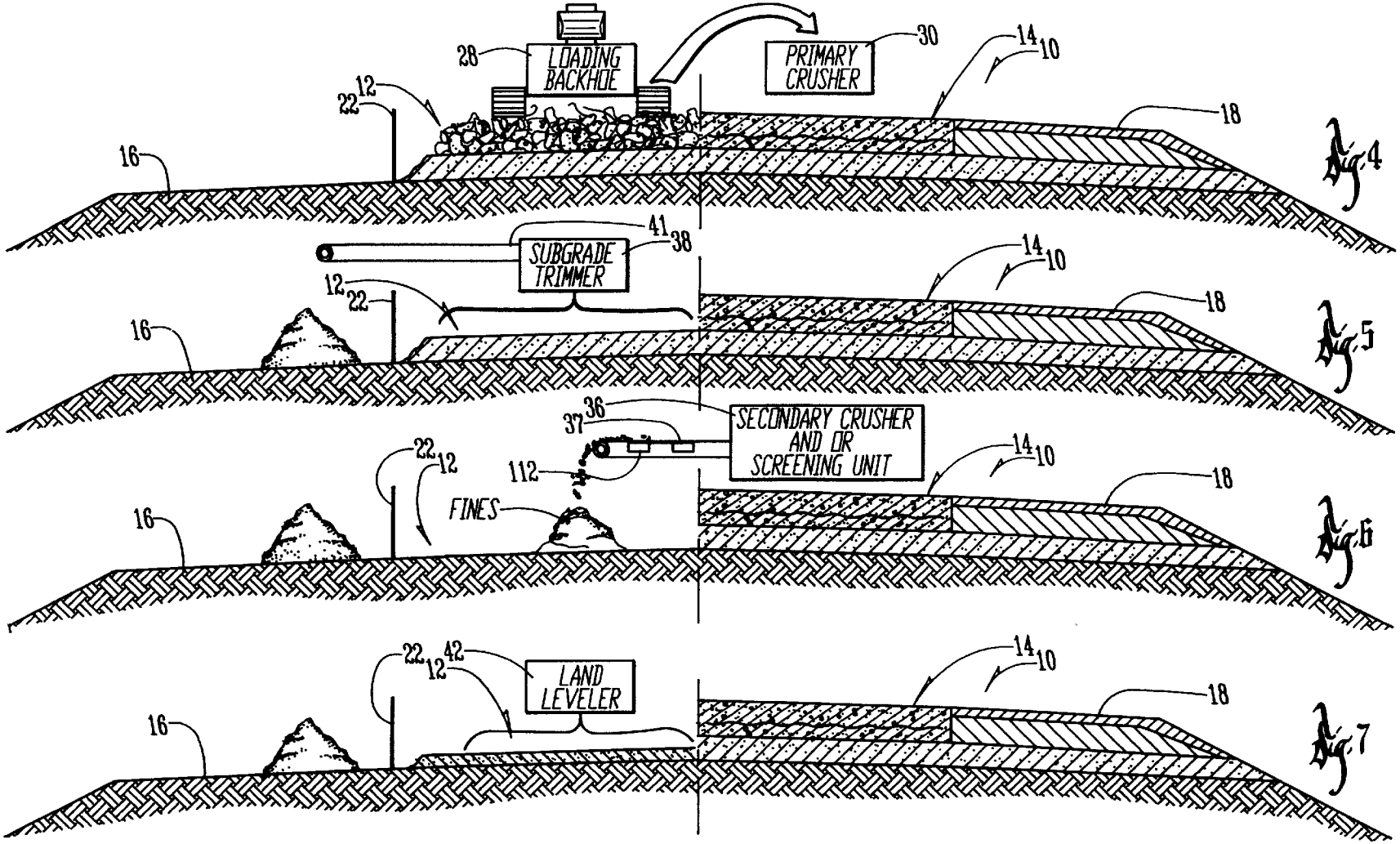
FIG. 4 is a cross sectional view of the pavement, taken along line 4—4 in FIG. 1, which shows the work done by the loading backhoe.
FIG. 5 is a cross sectional view of the pavement, taken along line 5—5 in FIG. 1, which shows the ground prepared for replacement paving by the subgrade trimmer.
FIG. 6 is a cross sectional view, taken along line 6—6 in FIG. 1, which shows the secondary crusher and/or screening unit depositing fines on the lane being recycled.
FIG. 7 is a cross sectional view of the pavement, taken along line 7—7 in FIG. 1, which shows the land leveler spreading out the fines.

FIGS. 1 and 4 show the next step in the recycling process. A loading backhoe 28 having a bucket at the free end of its hydraulic boom arm loads the separate chunks of concrete rubble into a hopper at the top of the primary crusher 30 near its forward end. The loading backhoe 28 is preferably track driven for the same reasons mentioned above relative to the backhoe ripper 26. The Model 235C Excavator manufactured by Caterpillar has been found to perform this loading function well.

Preferably, a four-wheeled skid steer loader 32, such as the 1845C Model manufactured by Case Equipment Co., assists the loading backhoe 28 by raking up loose rubble chunks and placing them into a pile to be scooped up by the bucket 94 of the loading backhoe 28. Using a rake bucket 94 having slots 92 spaced one to two inches apart helps filter out subgrade dirt and smaller materials while insuring that larger chunks of concrete rubble are loaded. The four wheel drive of such skid steer loaders makes them highly maneuverable and well-suited for these tight quarters.

The concrete rubble chunks are deposited by loading device 28 into the hopper of a self-propelled primary crusher 30 wherein the rubble is crushed and/or chopped conventionally into smaller pieces. Primary crusher 30 is preferably equipped with a magnetic means 90 for separating any steel reinforcing structures from the concrete rubble. The chopped and/or crushed steels are then discharged by a pivotable magnetic separating conveyor 33 into a collection bin 34 or into a windrow on shoulder 18. The primary crusher 30 is also preferably equipped with selectively extendible wheels 174 for ease of transport to and from the site (see FIGS. 14 and 25).

Figure 14:
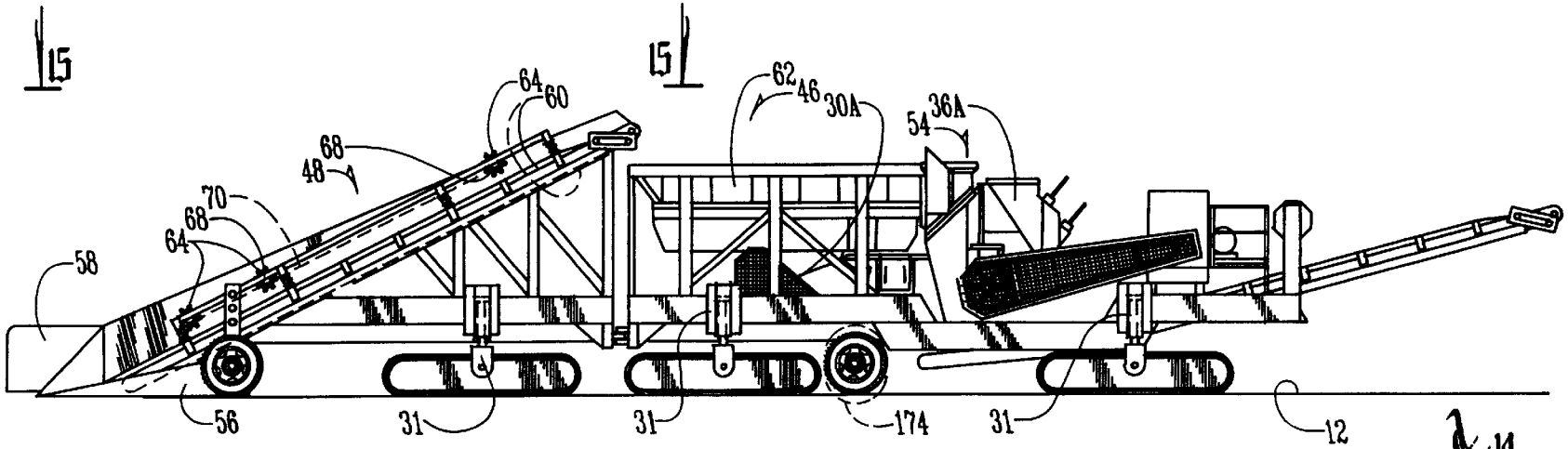
FIG. 14 is an enlarged side view of the integrated crusher/loader of FIG. 13.
Figure 16:
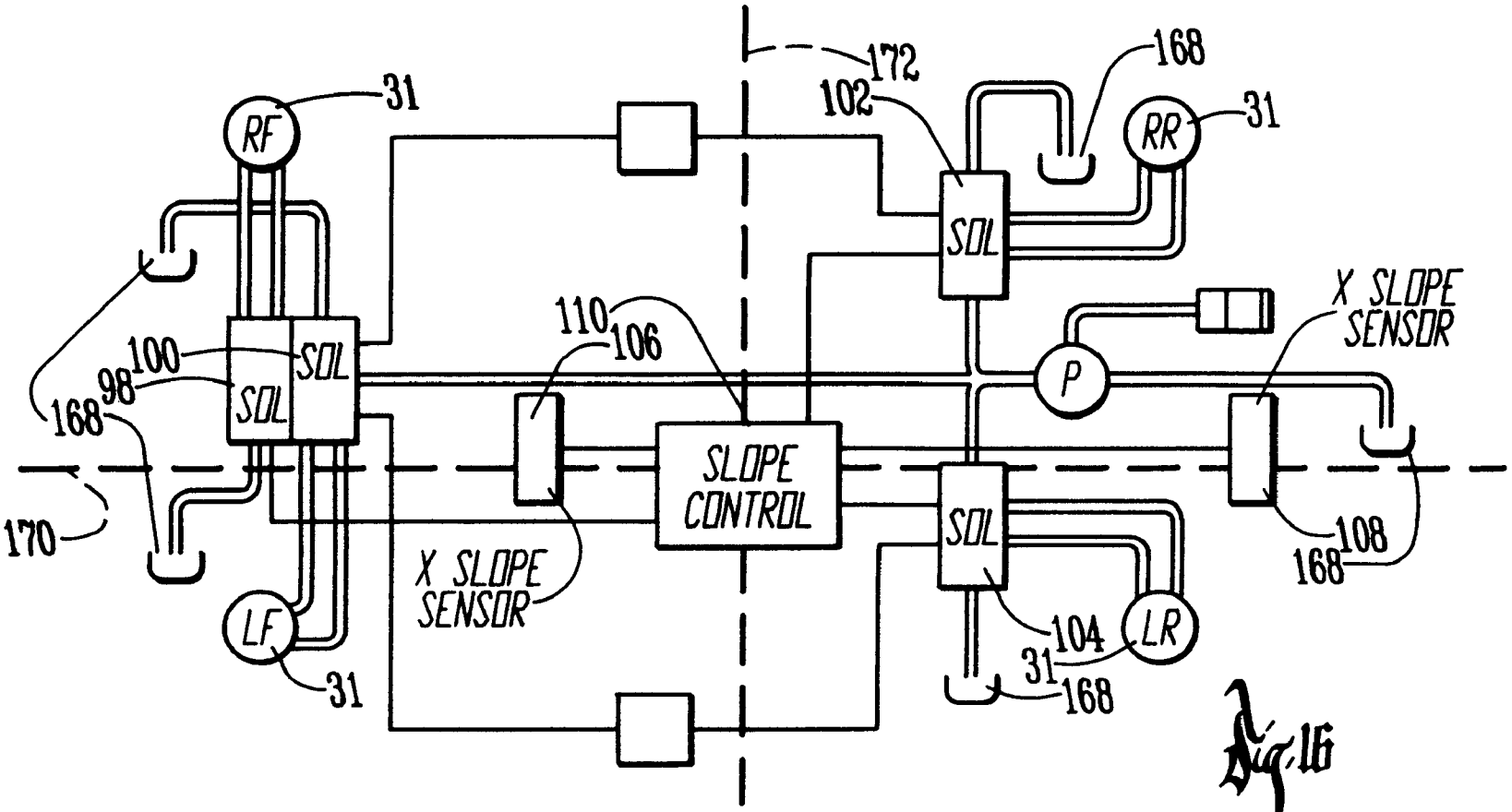
FIG. 16 is a schematic diagram showing the leveling circuit for the self-leveling crusher of the present invention.
Figure 25:
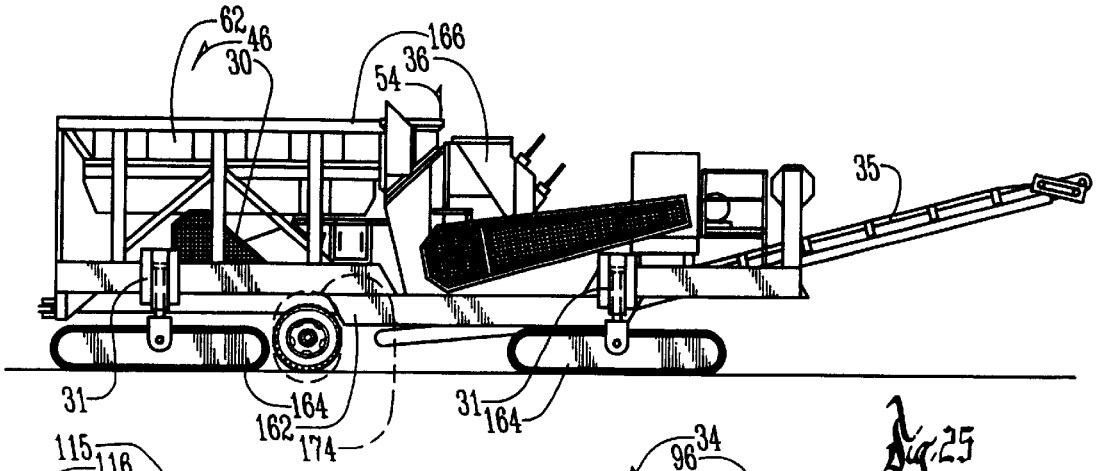
FIG. 25 is a side elevation view of the self-leveling crusher of this invention.

The mobile primary crusher 30 is track-driven, modified version of the standard Roadrunner 130/150 manufactured by Construction Equipment Company of Tualatin, Oreg. The particular crushing mechanism utilized by crusher 30 is not critical to this invention. For instance, jaw, impact, cone or other conventional mechanisms will suffice. For purposes of the present invention, however, one preferred modification is that the tracks of primary crusher 30 are equipped with hydraulic elevation cylinders 31, as shown in FIGS. 14, 16 and 25, for adjusting the level of the crusher. These cylinders are controllable with conventional manually or automatically actuated solenoid valves 98, 100, 102 and 104 controlled by a cross-slope control 110, preferably located on the operator platform 54. Cross-slope sensors 106 and 108 are mounted so as to extend across the front and rear portions of the crusher respectively and provide the control 110 with feedback as to the levelness of the crusher. The cylinders 31 provide individual or independent adjustment of the vertical extension of the tracks 88, 164 so as to maintain a level crusher even when an incline, a banked curve, or other nonlevel portion of the roadway is encountered. Without this modification the contents of the crusher would be subjected to undesirable shifting. Such shifting could improperly load the crusher and its operating components. A mechanical failure could result.

Figure 26:
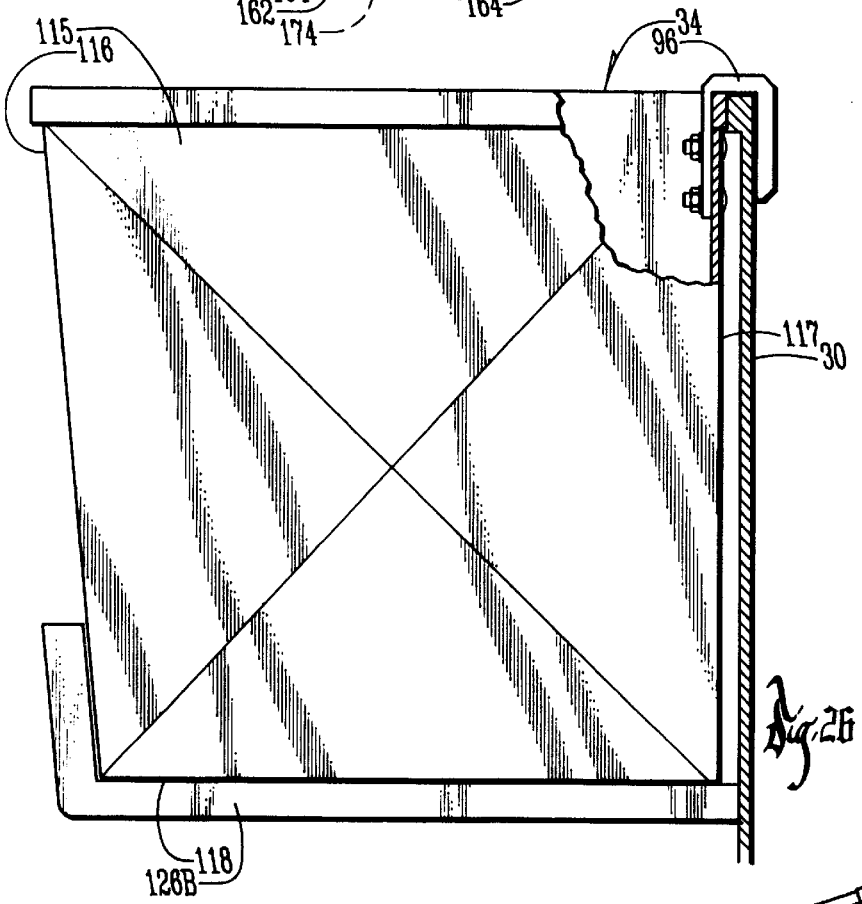
FIG. 26 is an enlarged partial sectional view taken from line 26—26 in FIG. 1, showing the collection bin detachably mounted to the crusher by hanging brackets.
Figure 27:
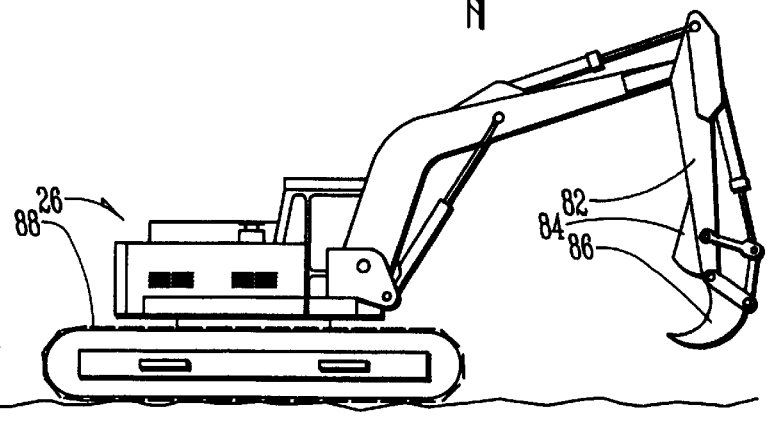
FIG. 27 is an enlarged side view taken along line 27—27 in FIG. 1, showing the backhoe ripper in greater detail.

Another preferred modification of the crusher for the present invention is detachably mounting a conventional collection bin 34 to its side with a pair of hanging brackets 96 to catch the discharged steels. As seen in FIG. 26, the bin is removable or detachable and can be dumped by conventional means, such as a skid steer loader 120 (see FIG. 19). This is far less wasteful and time-consuming than discharging the steels in windrows and picking them up later. For another detachable embodiment, see FIGS. 19–23 and the discussion thereof under the heading "DUMPABLE COLLECTION BINS" below. It is also contemplated that bin 34 can be attached to the crusher 30 in a way that generally precludes detachment, but still allows the contents to be readily dumped even while the crusher is moving. See FIG. 24 and discussion thereof under the heading "DUMPABLE COLLECTION BINS" below.

The primary crusher reduces the size of the concrete rubble from approximately 18 inches in diameter to about 3–4 inches in diameter. In one embodiment, the rubble is routed to a nearby screening unit 36 which returns any oversized product back into the input hopper of the primary crusher. Through such recycling of the rubble back through the primary crusher, a finished multi-gradated aggregate product which meets the size specifications for use as granular subbase or the granular products can be generated by a single crusher.

However, in another embodiment, 36 represents a secondary crusher in which further crushing and/or screening insures a consistent finished product with an acceptable cycle time. In either case, the rubble pieces from primary crusher 30, along with any residual steels and fines (such as dirt), are conveyed by conventional means 35 to a mobile secondary crusher and/or screening unit 36 which is towed directly behind the primary crusher 30 in the lane 14 by a conventional hitching means as shown in FIG. 1. The secondary crusher is of the type manufactured by Cedarapids, Inc. The secondary crusher 36 is preferably on wheels equipped with tires and is pulled by the primary crusher 30 which also serves as a source of electrical power for the secondary crusher 36. The wheels make it easier for the secondary crusher to be transported to and from the site. The wheels provide fairly low frictional resistance, making it easy for the primary crusher to tow the secondary crusher, but it is also contemplated that the secondary crusher can be equipped with disengageable wheels whereby steel tracks or corrugated profile rubber belts for on-site propulsion are operable when the wheels are disengaged. While this motive arrangement requires more drawbar force, it results in improved traction under wet ground conditions.

When utilized, the secondary crusher 36 further reduces the size of the rubble pieces by chopping and crushing the rubble in a conventional manner with a jaw, single roll, double roll, triple roll, impactor, or cone style crushing mechanism. The main products that result are multi-gradated aggregates around one inch in diameter or other size as dictated by the contract specifications for granular subbase or other desired uses. Any residual steels are discharged from the secondary crusher and/or screening unit 36 via magnetic separating conveyor 43 into either a collection bin 40 mounted to the side of the secondary crusher/screening unit or a windrow on shoulder 18. The residual dirt, sand, and other nonmetallic fines are also segregated from the concrete and discharged, as shown in FIGS. 1 and 6, in lane 12 behind a track-driven subgrade trimmer 38 via a pivotable conveyor 37. FIG. 1 shows that these fines can optionally be spread across the adjacent lane 12 by a land leveler 42 which is pulled behind the subgrade trimmer 38. The result is shown in FIG. 7. Sometimes the construction contract may allow the fines excess to be mixed back in with the aggregate in the crusher rather than discharged separately.

FIGS. 1 and 8 show how the crushed concrete that remains is discharged from the secondary crusher 36 via a pivotable conveyor 39 onto lane 12 behind the land leveler 42. It is contemplated that conventional load cells 112 can be integrated into any of the conveyors or discharge means to weigh and control the material output therefrom.

The crushers generate an immense amount of dust during their normal operation. Therefore, it is preferable to provide some means of dust control and abatement. Many conventional means of dust abatement are known. Among them are fine mesh air socks (filters), forced air filtration, foam spray, and water spray. For the purposes of illustration, only the water spray means is shown in the drawings though other means of dust abatement will suffice with this invention. A water tanker 44 can be pulled just behind the secondary crusher 36 or pushed just in front of the primary crusher 30 via a conventional hitch 45 and water hookups. Alternately, water tanks may be provided on the primary crusher 30. These tanks can be refilled by the tanker 44 when necessary.

The fluid from the tanker also serves the function of prewetting the crushed concrete rubble pieces and/or fines so that they do not generate dust upon their discharge. As is well known in the art, the fluid aids in the compaction process as well.

Figure 11:
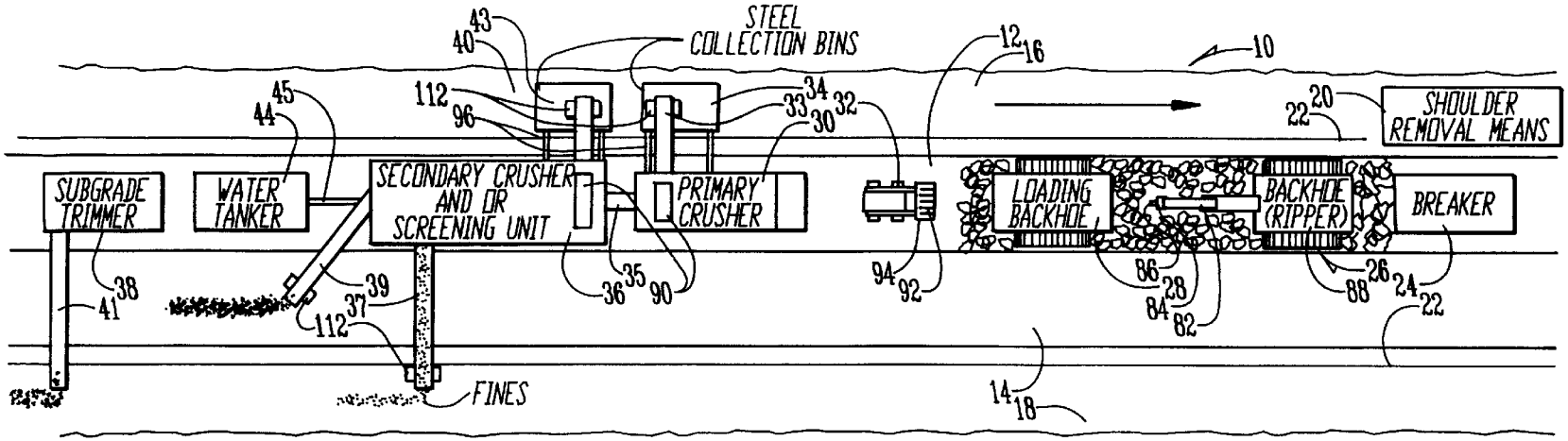
FIG. 11 is a schematic diagram which shows an alternate embodiment of the present invention, wherein the equipment, including the trimmer is arranged in a basically in-line configuration and the resulting multi-gradated aggregate products for granular-subbase are deposited in the adjacent lane.
Figure 13:
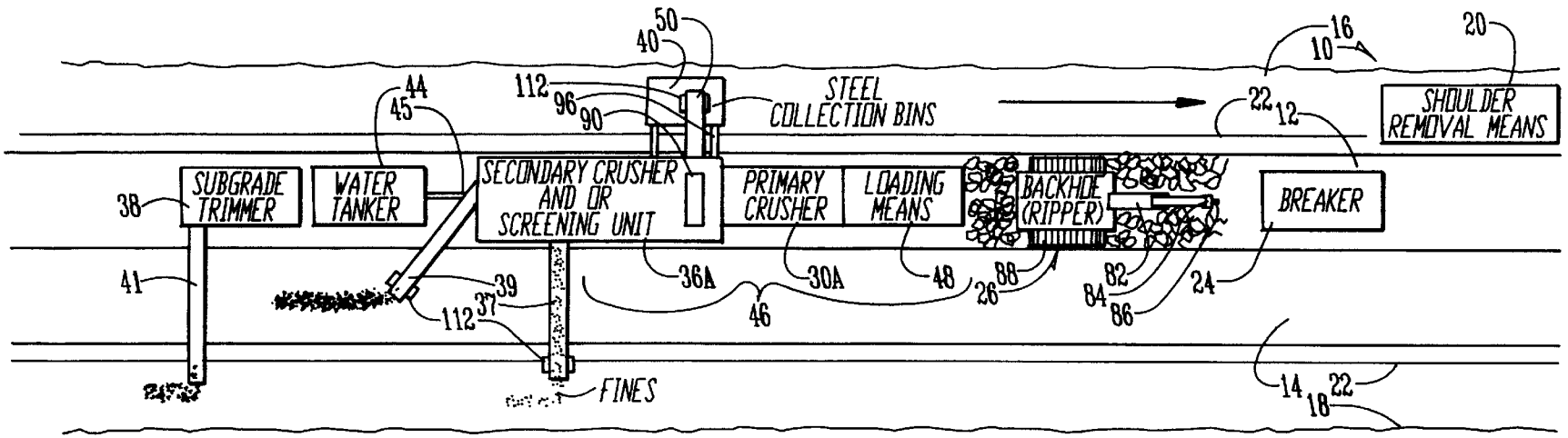
FIG. 13 is a schematic diagram of an alternate in-line embodiment of the present invention, similar to that of FIG. 11, but with an integrated crushing/loading means.

While the rubble is being crushed, subgrade trimmer 38 trims the subgrade dirt exposed in the inside lane 12 where the rubble has been removed. The subgrade trimmer 38 is a conventional, mobile piece of construction machinery, such as the Model 9500 Trimmer/Placer manufactured by Gomaco Corp. of Ida Grove, Iowa. The track-driven trimmer 38 crawls along stringline 22 and final grades the subgrade dirt to its final elevation specifications. The trimmer 38 discharges any excess dirt or material via a rear-mounted pivotable conveyor 41. The material is deposited on shoulder 16 of the roadway as shown in FIG. 1, but the trimmed material could also be deposited on shoulder 18 as shown in FIGS. 11 and 13. Of course, the discharge ends of the various conveyors must be staggered to keep the materials separate from each other. If the depth of cut required of the trimmer is too great, multiple passes can be made to abide by power and quality constraints.

HALF-WIDTH, INSIDE LANE FIRST METHOD

This embodiment of the present invention which is depicted in FIG. 1, begins after the conventional steps of removing the inside shoulder and setting stringline 22. The half-width, inside lane first method of recycling pavement begins with the concrete of the inside lane 12 being broken up into pieces of rubble by a mobile breaker 24. Preferably, this breaking is done while the concrete lays on the roadbed and leaves it in rubble thereon. A backhoe 26 follows and rips up the concrete rubble, breaking it into chunks no larger than approximately 18 inches in diameter. If the concrete is steel reinforced, the cutting shears 84, 86 of the backhoe ripper 26 also snips any steel which interconnects the larger chunks of rubble.

Loading means, such as a backhoe 28 with a bucket, places the rubble into a mobile primary crusher 30. Preferably, a skid steer loader 32 with a rake bucket 92, 94 gathers the rubble into a convenient pile for the backhoe 28 to load. The primary crusher 30 positioned on lane 14 crushes the rubble chunks into smaller pieces after separating and discharging any steels via a magnetic separating conveyor 33 for later recycling. Then the remaining rubble is transferred to the secondary crusher 36 where it is crushed into smaller pieces yet. The sand and other fines are also screened out by the secondary crusher 36. These fines are discharged behind a subgrade trimmer 38 which travels on lane 12 alongside the crushers. Optionally, the fines can be spread across the trimmed subgrade of the inside lane 12 by a land leveler 42 which is pulled behind the trimmer 38. The trimmer 38 discharges the trimmed material to a convenient location, such as shoulder 16. In the same manner as in the primary crusher 30, any steel present is separated and discharged from the secondary crusher 36 by a magnetic separating conveyor 43.

The crushed concrete which results is approximately one inch in diameter or less. The crushed concrete can to be reused, serving as multi-gradated aggregate product for almost any construction use. In the particular construction use described herein, the crushed concrete from the roadway serves as granular subbase for almost immediate replacement paving thereof. The granular subbase is spread on the lane 12 behind the land leveler 42 via a pivotable discharge conveyor 39. With the appropriate conventional grading and rolling, the granular subbase is ready to have replacement pavement poured thereon.

SECOND LANE REMOVAL

After some length of the inside lane 12 has been recycled as described above, the equipment can be moved into the configuration shown in FIG. 9. The equipment can move in reverse, backup, and turn around as necessary. Although it should be understood that the equipment could process the second lane 14 in either direction, the arrows in FIG. 9 show that the equipment is heading in the opposite direction from that shown in FIG. 1. The train is returning toward the original starting point in the adjacent lane.

In this case, the breaker 24, backhoes 26 and 28, and skid steer loader 32 are breaking and loading the pavement of lane 14 into crushers 30 and 36. Crusher 30 pushes water tanker 44 and pulls secondary crusher 36 on the inside lane 12. If the specifications for lane 12 allow it, multi-gradated aggregate products (crushed concrete) can be discharged for granular subbase via pivotable conveyor 39 as shown in FIG. 9. Otherwise, the aggregate can be discharged as shown in FIG. 9 and moved to whatever location is desired by using conventional grading means. If the aggregate is not desired for immediate use as granular subbase, conveyor 39 can also be redirected to discharge it in a windrow to either shoulder 16 or 18.

The subgrade trimmer 38 follows behind crusher 36 in the adjacent lane 14 and discharges trimmed material over the windrow of granular subbase left by the crusher to shoulder 16 via conveyor 41. Fines from the secondary crusher 36 are discharged via conveyor 37. Steels from the primary and secondary crushers can be discharged to shoulder 16 via conveyors 33 and 43 respectively. For ease of subsequent cleanup, the steels are preferably discharged into collection bins 34 and 40 which are mounted to the side of the respective crushers.

Since the fines are deposited on the shoulder instead of behind the trimmer 38, there is no need for a land leveler to follow the trimmer spreading the fines. One advantage of this configuration is that with the obvious exception of the granular subbase, all materials for later use, recycling or reclamation are placed in bins or windrows staggered for easy pickup along the outside shoulder.

THE IN-LINE METHOD

FIG. 11 shows another alternate embodiment of the present invention wherein all of the equipment travels in a train-like, in-line fashion up a single lane of pavement. Here, lane 12 is broken up, loaded and crushed. However, this method could also be applied to lane 14 by moving the equipment to that lane and reversing its direction of travel. Steel is discharged from primary and secondary crushers 30 and 36 to collection bins 34 and 40 via the magnetic separating conveyors 33 and 43. The fines from the secondary crusher 36 are discharged to shoulder 16 via a pivotable conveyor 37. The multi-gradated aggregate (crushed concrete) for granular subbase is discharged via a similar conveyor 39 to lane 14. The water tanker 44 is pulled behind the secondary crusher 36 on inside lane 12 to supply water for the crushing process. The subgrade trimmer 38 is the last piece of equipment in the train on lane 12, preparing the ground for the laying of the subbase and replacement concrete. It should be apparent that this method would also be suitable for return trip recycling after the method of FIG. 1. The use of pivotable conveyors and equipment that can travel on subgrade, subbase, or pavement provides a great deal of flexibility in the establishing economical recycling methods.

DOUBLE LANE METHODS

Figure 12:
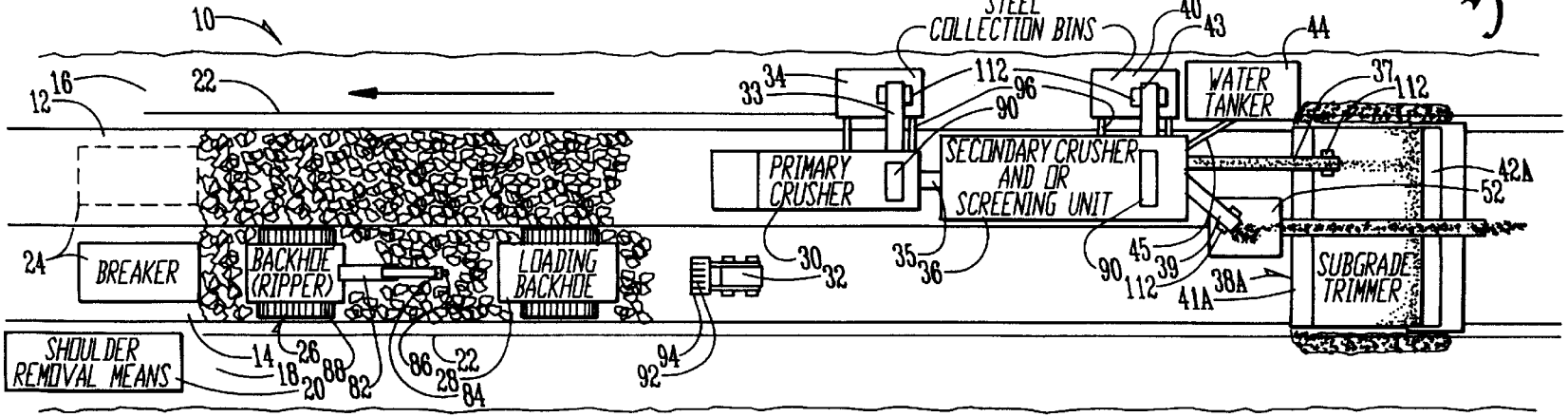
FIG. 12 is a schematic diagram which shows an alternate embodiment of the present invention, wherein two lanes are recycled simultaneously.

FIG. 12 shows another embodiment of the present invention wherein two lanes of pavement are recycled simultaneously. The breaker 24 breaks up both lanes of pavement 12 and 14. After breaking sufficient pavement in lane 12 to keep the backhoes 26 and 28 busy, the breaker 24 switches lanes and breaks the pavement in lane 14. Thus, the breaker 24 alternately advances in one lane and then the other lane. The backhoes 26 and 28 generally follow the breaker 24, working both lanes as needed to maintain the steady and coordinated progress of the recycling operation. Assisted by the skid steer loader 32, the loading backhoe 28 places the rubble chunks into primary crusher 30.

The processing of the rubble proceeds as stated above until the various materials are discharged from the secondary crusher 36. Magnetic material is discharged into collection bins 34 and 40 via conveyors 33 and 43. Fine materials are discharged rearwardly between a two-lane subgrade trimmer 38A and a two-lane land leveler 42A which is drawn behind. The two-lane subgrade trimmer discharges the excess material from trimming to both shoulders 16 and 18 via auger 41A. The fines are subsequently spread across the subgrade dirt of both lanes 12 and 14 by land leveler 42A which is towed behind trimmer 38A.

The recycled concrete or multi-gradated aggregate for granular subbase is deposited via pivotable conveyor 39 and mobile extension 52 in a windrow along the centerline between the lanes 12 and 14 behind the land leveler 42A. The granular subbase can easily be distributed by conventional grading means to both lanes from that central location. Conventional means are used to grade the subbase appropriately before the replacement concrete is poured thereon. A water tanker 44 traveling on shoulder 16 supplies water for dust control to the secondary and primary crushers 36 and 30 by conventional fluid connections.

Figure 17:
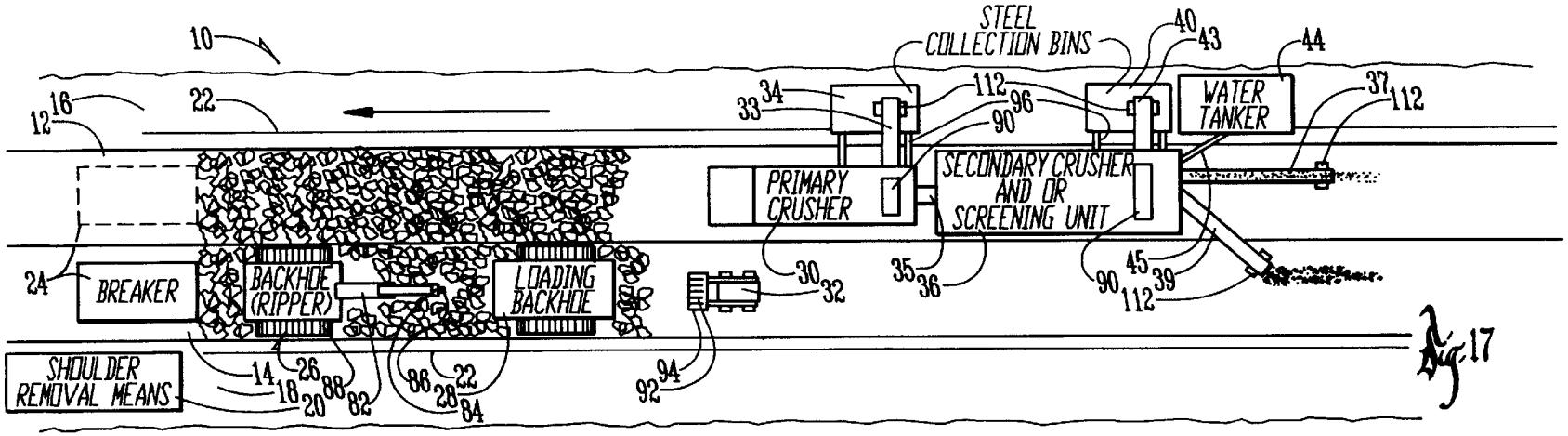
FIG. 17 is a schematic diagram similar to FIG. 12, but showing the configuration of equipment and the method for recycling two lanes at one time without simultaneously trimming the exposed subgrade.
Figure 18:
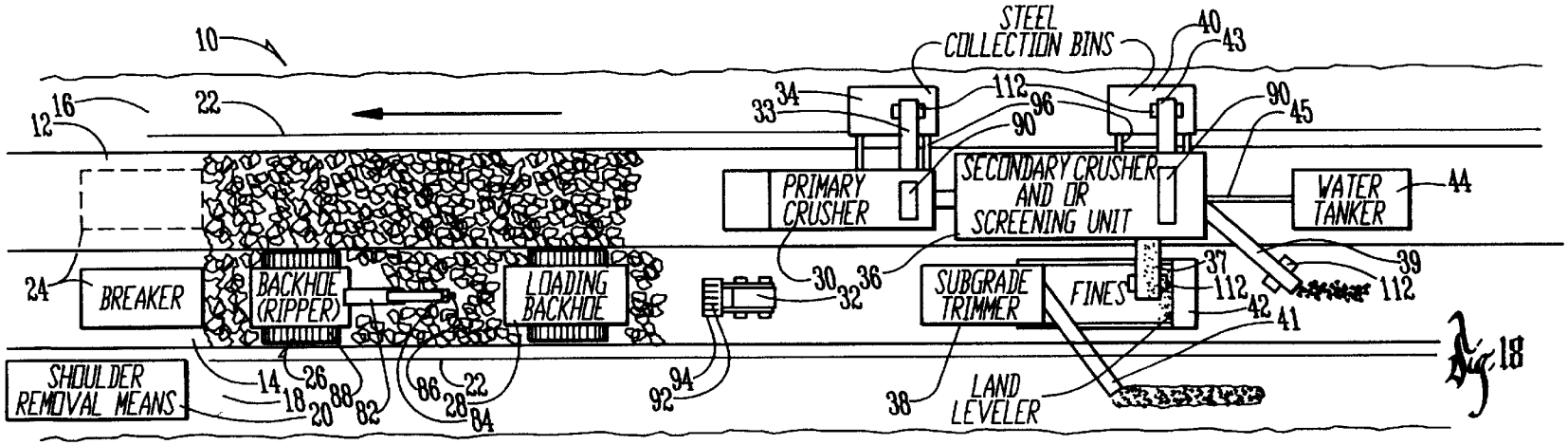
FIG. 18 is a schematic diagram similar to FIG. 17, but shows a single-lane subgrade trimmer and land leveler trimming the subgrade in the lane adjacent the crusher.

FIGS. 17 and 18 show other embodiments or variations of the present invention wherein two adjacent lanes of pavement are recycled simultaneously. FIG. 17 depicts a situation in which it is unnecessary to trim the underlying subgrade while crushing the pavement. Sometimes the subgrade trimming can be delayed or is entirely unnecessary given the condition of the subgrade. For instance, in more mountainous regions the subgrade is an essentially solid rock surface. In these instances, contract specifications generally allow trimming of the subgrade to be omitted. The apparatus and method shown in FIG. 17 differs from that shown in FIG. 12 in that the trimmer has been omitted and the pivotable conveyor 39 extends into the lane 14 adjacent the crusher 30. The conveyor 39 deposits the multi-graded aggregate for granular subbase onto the roadway in a windrow in lane 14. One skilled in the art will recognize from this disclosure that conveyors 37 and 39 could be pivoted so as to deposit their materials in other locations, if desired. Furthermore, the water tanker 44 can be provided in various positions near the secondary crusher 36.

FIG. 18 shows another embodiment of the present invention wherein two lanes of pavement are recycled simultaneously, but the subgrade is trimmed only in one lane. A single-lane subgrade trimmer 38 is positioned in the lane 14 adjacent the crushers 30, 36. Fine materials from the crushers 30, 36 are discharged rearwardly between the single-lane subgrade trimmer 38 and a single-lane land leveler 42 attached in following relation thereto. The subgrade trimmer 38 has a pivotal auger 41 which discharges the excess trimmed material to the shoulder 18. Meanwhile, the land leveler 42 spreads the fines across the lane 14. The portable conveyor 39 of the crusher deposits the multi-gradated aggregate for granular subbase in a windrow on lane 14. Because the fines are directed onto lane 14, the water tanker 44 can be located directly behind the crusher 30, 36 in lane 12.

INTEGRATED LOADER-CRUSHER MEANS AND METHOD

FIG. 13 shows another apparatus and method for recycling pavement where the loading and crushing means are combined to form an integrated, self-propelled, self-feeding, two-stage crushing machine 46. The crushing machine 46 is comprised of a primary stage 30A similar to primary crusher 30, a secondary stage 36A similar to secondary crusher 36, and loading means 48 which integrates the loading function into the crushing machine.

FIG. 14 shows that the loading means 48 is a tiltable shovel blade wedge 56 directed at the ground in front of the crusher. The blade 56 has a forwardly-extending, rubble-directing wing 58 on one side thereof which guides rubble back toward the center of the lane and blade 56. The width of the blade tapers as it rises and engulfs one end of an inclineable conveyor 60 having generally horizontal spaced-apart moving slats 66. The top surface of the blade wedge 56 is tapered inwardly and sloped downwardly toward the conveyor 60 to utilize gravity in directing the rubble chunks thereto.

Figure 15:
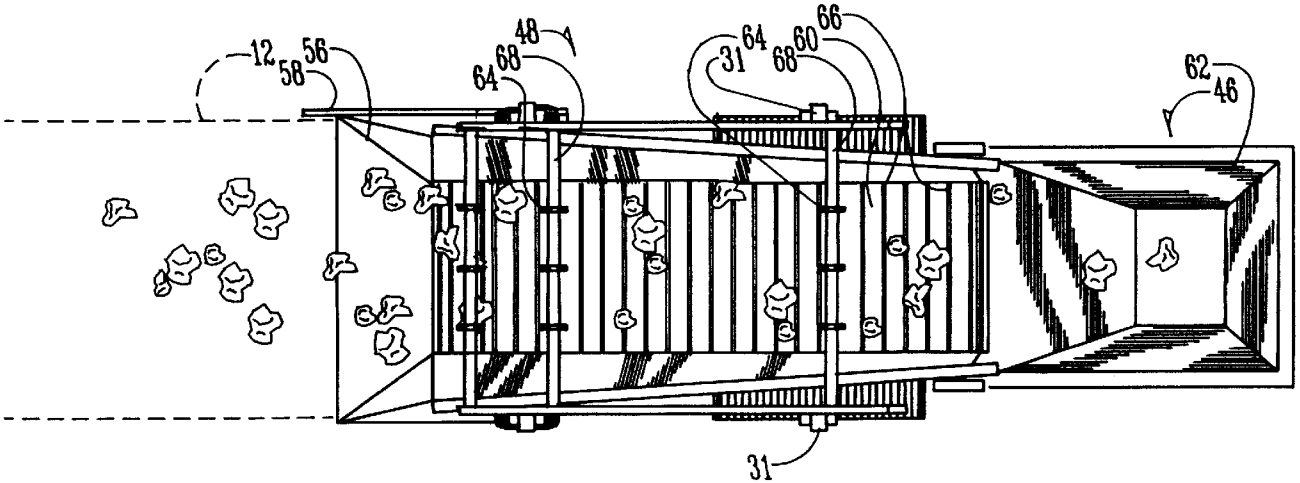
FIG. 15 is a top view of the wedge and conveyor of the present invention as taken along line 15—15 in FIG. 14.

As shown in FIG. 15, the conveyor 60 moves the rubble upwardly and eventually into the hopper 62 of the primary stage 30A of the crusher. Powered vertical cog-shaped wheels 64 are mounted in a spaced apart set on a series of generally horizontal shafts 68 in spring-loaded suspension over the conveyor and assist it in moving the chunks of rubble up the conveyor.

In the preferred embodiment shown in FIGS. 14 and 15, a cog wheel 64 is placed six inches in from each side of the conveyor 60 and one is placed at the center of the six foot wide conveyor. As the size of the rubble conveyed varies, it is contemplated that the number of shafts, cogs per set, and their locations can be altered accordingly.

Each shaft may be driven individually to rotate its respective cog wheels 64 or the shafts 68 may be driven in unison by conventional means such as chain 70 interconnecting them. Preferably the speed and action of the cog wheels and conveyor are roughly synchronized and coordinated. Preferably two sets of cog wheels are positioned near the bottom of conveyor 60 to relieve congestion of rubble there and one set of cog wheels is positioned closer to the top end of the conveyor 60. The outer cog wheels 64 in each set is particularly helpful in conjunction with the inwardly sloped top surface of blade 56 in directing the rubble toward the center of the conveyor and upward toward the hopper 62. As the crusher 46 travels forward, the chunks of rubble are forced onto the conveyor, which subsequently dumps them into the primary stage 30A.

Referring again to FIG. 13, steel is separated and discharged to collection bin 40 or onto shoulder 16 via a single pivotable separating magnetic conveyor 50. Fines are discharged in a windrow to shoulder 18 via a pivotable conveyor 37. The recycled concrete or multi-gradated aggregate for use as granular subbase is discharged to the center of the adjacent lane 14 via a pivotable conveyor 39. A water tanker 44 is pulled behind the crusher and plumbed conventionally to the same to provide fluid for dust control.

A subgrade trimmer 38 follows the water tanker 44 to trim the ground to grade. The trimmings are discharged to shoulder 18 via pivotable conveyor 41. This compact train-like apparatus is extremely efficient when used according to the following method. The train proceeds down one lane.

The crushed concrete or multi-gradated aggregate resulting from that lane is deposited in a windrow on the adjacent lane and is available for any number of construction uses, including use as granular subbase. The fines, trimming, and steel by-products are deposited on the shoulders 18 and 16.

DUMPABLE COLLECTION BINS

Figure 19:
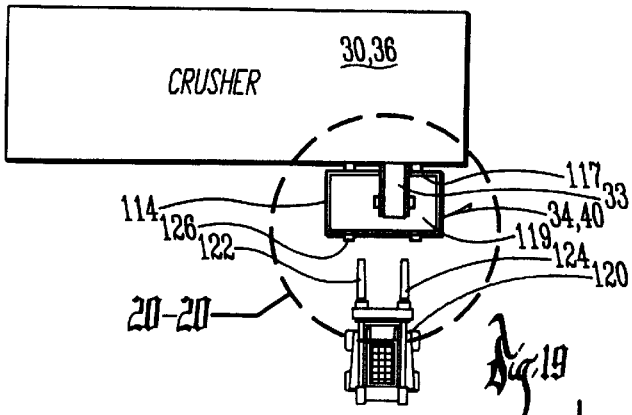
FIG. 19 is a top view of the crusher and surrounding area, which shows the detachable and dumpable collection bin and method of recovering steels according to the present invention.

Because collection bins 34 and 40 are substantially identical, the description below will refer primarily to bin 34 on the primary crusher 30 with the understanding that the description is equally applicable to bin 40 on the secondary crusher 36. FIG. 19 shows a collection bin 34 that is easily detachable or removable from the crusher 30 for the purpose of dumping the steels deposited in the bin. A conventional skid steer loader 120, having horizontally spaced left and right forks 122, 124 respectively mounted thereon approaches the side of the crusher 30. A platform 126 on the side of the crusher 30 supports the bin 34. The collection bin 34 includes opposite side walls 114, 115, a front wall 116, a rear wall 117, a bottom wall 118 and a top opening 117.

Figure 20:
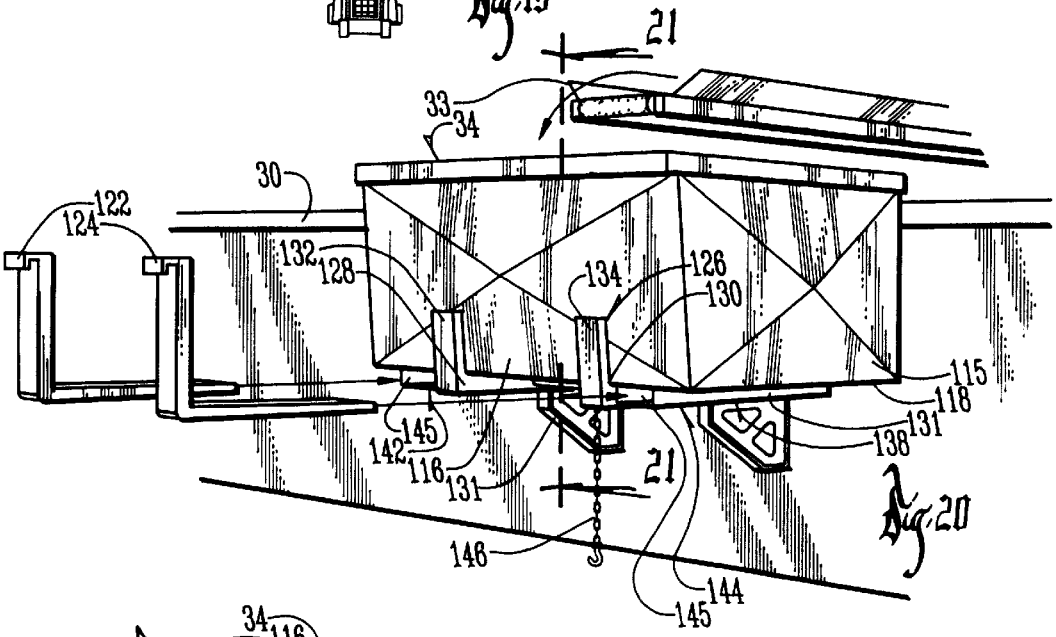
FIG. 20 is an enlarged perspective view of area 20—20 from FIG. 19 and shows the detachable and dumpable collection bin of the present invention in greater detail.

As best seen in FIG. 20, the platform 126 detachably mounts the bin 34 to the side of the crusher 30. The platform 126 includes a pair of horizontally spaced apart L-shaped legs 128, 130. The longer, horizontal portion of each leg 128, 130 has one end attached to the crusher 30. Braces 131 can be included for additional structural support, if necessary. The other end of each generally horizontal leg 128, 130 extends under the bin 34 and has a foot 132, 134 extending upwardly. The foot 132, 134 constrains the bin 34 from movement away from the side of the crusher 30.

Figure 21:
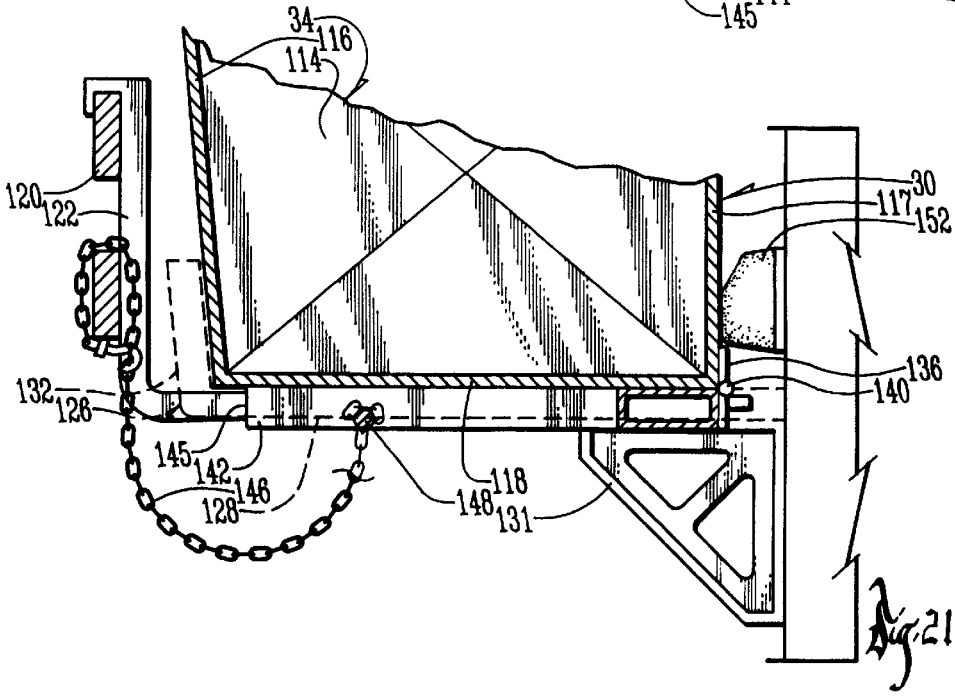
FIG. 21 is a sectional view of the detachable and dumpable collection bin of this invention taken along line 21—21 of FIG. 20.

The dumping bracket 135 includes a mounting plate 136 for attaching the dumping bracket 135 to the bin 34 as seen in FIGS. 20 and 21. Preferably the mounting plate 136 attaches to the rear wall 117 or bottom wall 118 of the bin 34. However, the mounting plate 136 may be attached to one of the side walls 114, 115 without detracting from the present invention. Under those circumstances, the bin 34 will be dumped to the side.

The mounting plate 136 is attached by a hinge 140 to a hoistable portion 138 of the dumping bracket 135. The hoistable portion 138 includes a pair of spaced apart, generally horizontally disposed elongated tubes 142, 144. The tubes extend under the bin 34, generally perpendicular transverse to the side of the crusher 30. Each tube 142, 144 has an opening 145 therein that is adapted to receive the respective forks 122, 124 and therefore is normally disposed adjacent the front wall 116 of the bin 34.

When the bin 34 is placed on the platform 126, the tube 142 is preferably disposed adjacent the left side of the leg 128 in FIG. 20, while the tube 144 is adjacent the leg 130 on the right. By coordinating the spacing of the tubes 142 and 144 with the spacing between the legs 128 and 130 as shown, the legs effectively constrain the bin 34 against movement parallel to the side of the crusher 30.

In FIG. 21, a cable or a chain 146 attaches to the dumping bracket 135. Preferably the chain 146 has one end connected to the dumping bracket 135 at a cross bar 148 extending between the tubes 142 and 144, and another end secured by conventional means to the skid steer loader 120. The chain 146 helps retain the tubes 142, 144 on the forks 122, 124 so as to secure the bin 34. One or more stops 152 may be mounted to the side wall of the crusher 30 behind the rear wall 117 to prevent the bin 34 from striking the crusher 30 or shifting excessively once installed on the platform 126.

Figure 22:
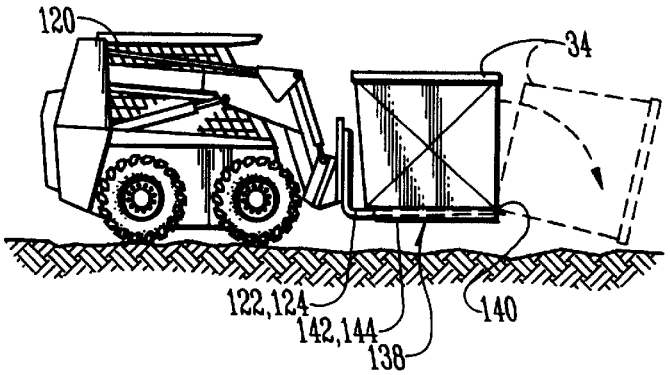
FIG. 22 is a side view of the detachable dumpable collection bin of FIG. 19 being transported and dumped by a skid steer loader.
Figure 23:
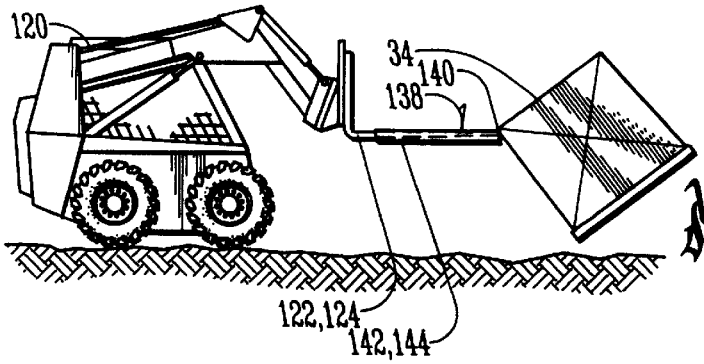
FIG. 23 is a side view of the collection bin of FIG. 19 being raised and emptied by a skid steer loader according to this invention.

FIGS. 22 and 23 further illustrate how the detachable bin 34 with the dumping bracket 135 operates. When the crusher 30 crushes concrete pavement with steels embedded therein, these steels are removed from the crusher via by the magnetic separating conveyor 33. The discharged steels fall into the opening 119 of the bin 34. When the bin is full or it is otherwise time for emptying it, an operator approaches the front wall 116 of the bin 34. The operator positions the skid steer loader 120 so that the forks 122, 124 register with the openings 145 in the tubes 142, 144. Then, the skid steer loader operator inserts the forks 122, 124 far enough into the tubes 142, 144 to fully support the bin 34. The operator then attaches the chain 146 to the skid steer loader 120 and the cross bar 148 on the dumping bracket 135 so as to retain the bracket and the bin 34 on the forks 122, 124. Next, the operator lifts the bin 34 with the loader 120 above the feet 132, 134 of the platform 126 and withdraws the bin therefrom. The operator may raise or lower the bin so it does not obstruct his or her vision while driving. The operator transports the bin 34 to a dumping site remote from the crusher 30.

In FIG. 22, the skid steer loader 120 has reached the dumping site, and is abruptly stopped. The resulting deceleration causes the bin 34 to tip forward or pivot about the hinge 140, thus dumping the contents of the bin 34. FIG. 23 illustrates that raising the forks 122, 124 will further encourage the steels to leave the bin 34. Rapidly jerking the skid steer loader 120 back and forth will return the bin 34 to its upright position on the forks 122, 124. The bin 34 is then returned to the position shown in FIG. 20 and the chain 146 is removed from the skid steer loader 120. Lastly, the operator withdraws the forks 122, 124 from the tubes 142, 144 by moving the loader 120.

Thus, it can be seen that the present invention provides an apparatus and method for efficiently handling steels recovered from reinforced concrete pavement crushed by the crusher 30, 36. Fortunately, the rate of forward progress of the crusher 30, 36 is slow enough to allow the skid steer loader 120 to remove and replace the bin 34 while the crusher 30, 36 is moving and crushing pavement.

Figure 24:
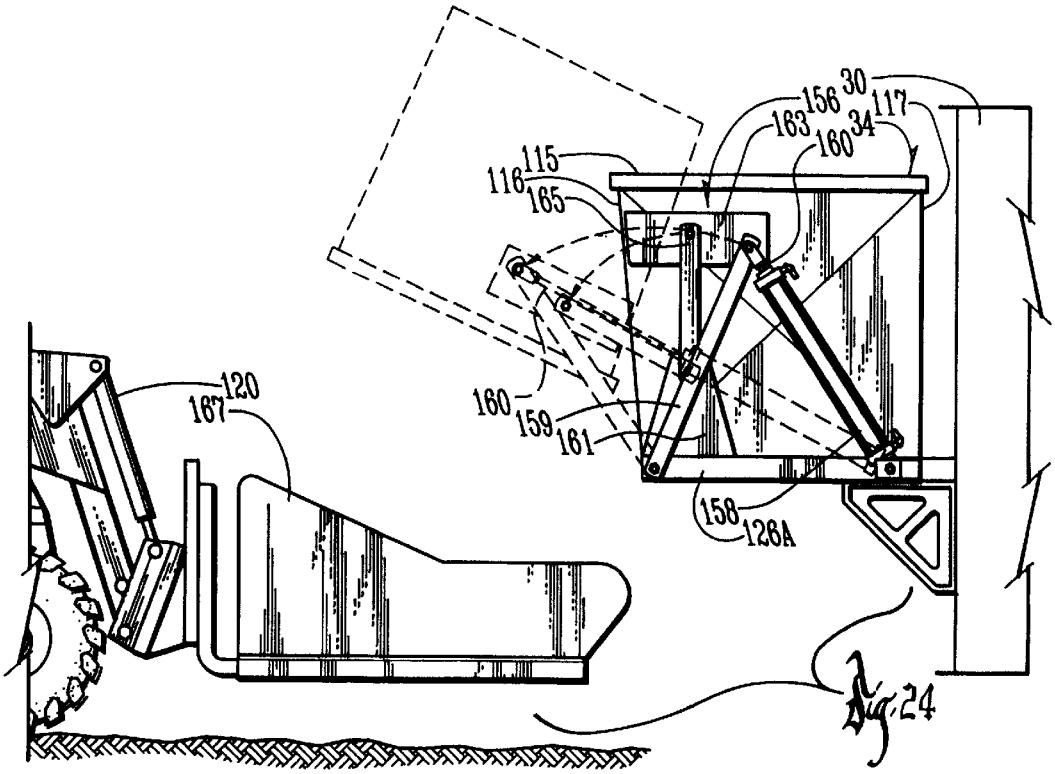
FIG. 24 is a side view of an alternate embodiment of the dumpable collection bin wherein a hydraulic tipping means is utilized.

An alternate embodiment of a dumpable steel collection bin 34 is shown in FIG. 24. In this embodiment the bin is not required to be detachable from the crusher 30. A platform 126A is attached to the side of the crusher 30 and supports the bin 34. The bin 34 is pivotally mounted on the platform 126A by a hydraulic tipping means 156 which interconnects the bin 34 and the platform 126A adjacent the crusher 30.

The hydraulic tipping means 156 includes a conventional cylinder 158 having a rod 160 hydraulically extensible from one end thereof. The free end of the rod 160 is pivotally connected to one of the sides 114, 115 of the bin 34 and the upper end of a first pivot arm 159. The end of the cylinder opposite the rod 160 is pivotally connected to the side of the platform 126A near its rear edge, adjacent the crusher 30, while the lower end of the first pivot arm 159 is pivotally connected to the side of the platform 126A adjacent its front edge.

An ear 161 having a base portion and an upper portion extends upwardly from the side of the platform 126A adjacent its front edge. Preferably, a stiffening plate 163 attaches to the side 115 of the bin 34. A second pivot arm 165 has one end pivotally connected to the upper portion of the ear 161 and another end pivotally connected to the stiffening plate 163.

As evidenced by the dotted lines in FIG. 24, hydraulically extending rod 160 from the cylinder 158 causes pivot arms 159, 165 to rotate about their lower pivotal connections, thereby pivoting or tipping the bin 34 forward. Thus, the contents of can be emptied into the pan 167 of a skid steer loader 120 positioned therebelow. The skid steer loader 120 then dumps its pan in a suitable location remote from the crusher.

After the contents of the bin 34 have been emptied, the hydraulic tipping means 156 retracts the rod 160 to return the empty bin 34 to its upright position on the platform 126A. The hydraulic tipping means 156 can be remotely actuated from the operator station 54 on the crusher 30, along with the other hydraulic functions provided. Thus, the present invention dumps full steel bins hydraulically, remotely, and on-the-go (without disrupting or slowing down the crushing process).

Preferably, one or more stiff curtains or shields (not shown) are provided in front of the discharge conveyor 33 over the bin 34 for deflecting the steels into the bin rather than letting them escape onto the roadway. Similar shields are also optionally provided on the other discharge conveyors 37, 39, 41, 43 to control their discharges.

SELF-LEVELING CRUSHER

The self-leveling feature of the crusher 30, 36 of the present invention is described in detail below. The description focuses on how the primary crusher 30 achieves self-leveling. However, it will be understood by those skilled in the art that the same principles can be applied to the secondary crusher 36.

In FIG. 25, the crusher 30 includes a chassis 162 supported and propelled by a plurality of continuous loop tracks 164. The tracks 164 are steerable, i.e., they can be pivoted about a vertical axis. Furthermore, the tracks 164 are vertically extensible with respect to the chassis 162. As mentioned earlier, selectively extendible wheels 174 are also mounted on the chassis 162. When extended, the wheels 174 raise the chassis 162 and bring the tracks 164 off the ground so the crusher 30 can be towed.

A crushing means 166 disposed on the chassis 162 crushes the concrete chunks of pavement fed into the crusher 30 by the loading means 28, 32 and converts them into multi-gradated aggregate.

As a part of the present invention it has been discovered that it is desirable to maintain the crushing means 166 in a level attitude so as to optimize its performance and reduce the likelihood of breakdowns. Therefore, a plurality of hydraulic cylinders 31 are provided, one for each of the tracks 164. These hydraulic cylinders 31 are proactive, not reactive like a mere shock absorber, and interconnect each of the tracks 164 with the chassis 162 so as to make the tracks vertically extensible with respect thereto.

A hydraulic pump, designated by reference symbol P in FIG. 16, provides fluid for operating the hydraulic cylinders 31. The pump P fluidly connects the cylinders 31 through their respective valves 98, 100, 102, 104 in parallel circuits. Preferably the valves 98, 100, 102, 104 are eight bank, three position, spring centered to a closed position, twelve volt DC solenoid operated valves, such as commercially available through Waterman. By controlling the valves, each cylinder 31 can be extended and retracted individually, thus individually controlling the extension of the tracks 164 with respect to the chassis 162 and crushing means 166.

At least one cross slope sensor 106, 108 is mounted on the chassis 162 and generates a signal indicating the levelness of the chassis and crushing means 166 with respect to true horizontal. The cross slope sensor 106, 108 are available through Sauer-Sundstrand of 3900 Annapolis Lane N., Minneapolis, Minn. 55441 under the part number ACW112D1061. The sensor 106, 108 is preferably mounted so its internal pendulum swings across the chassis 162 and generates a signal indicative of the levelness between the sides of the crusher 30.

A closed-loop slope control 110 connects the sensor 106, 108 and each of the valves 98, 100, 102, 104. The slope control 110 receives signals indicative levelness from the cross slope sensor 106, 108. Based on the signal from the cross slope sensor 106, 108, the slope control 110 commands the appropriate solenoid valves 98, 100, 102, 104 to allow the fluid from the pump P to fill or evacuate the appropriate cylinders 31. Together the pump P, slope control 110, one or more cross slope sensors 106, 108, and valves 98, 100, 102, 104 constitute an electrohydraulic control means for controlling the extension of the individual cylinders 31.

In a first position, the solenoid valve 98, 100, 102, 104 opens so fluid from the pump P can fill cylinder 31. The corresponding track 164 will be extended away from the chassis 162 and that quadrant of the crusher 30 will be raised. In a second or centered position, the solenoid valve blocks the flow of fluid to and from the corresponding cylinder 31. The track 164 will maintain its current height or extension. In a third position, the solenoid valve 98, 100, 102, 104 opens so that fluid can drain from the corresponding cylinder 31 to the reservoir 168. The corresponding track 164 will be retracted toward the chassis 162 and that quadrant of the crusher 30 will be lowered. Thus, the cylinders 31 are individually and independently extended or retracted by the closed loop feedback circuit of FIG. 16 to maintain the crushing means in a level condition.

When a second cross slope sensor 108 is utilized, sensor 106 is placed between the right front and left front cylinders 31, while sensor 108 is placed between the right rear and left rear cylinders 31. Note the additional labeling in FIG. 16, which designates a longitudinal axis 170 of the crusher 30, a transverse axis 172 of the crusher, and respective quadrants of the crusher 30 where the cylinders 31 are located. The control 110 compares the signals between sensors 106, 108 and develops commands to the solenoid valves 98, 100, 102, 104 to affect both transverse and longitudinal corrections or adjustments to the levelness of the crushing means 166. The internal pendulum of each sensor can also be rotated 90° to measure levelness along a different axis.

The foregoing shows the present invention at least accomplishes its stated objectives. It will be appreciated that the present invention can take many forms and embodiments. For instance, the physical positioning of the equipment is not as important as its operative positioning. The ripper and loader need only be in the general vicinity of the crusher (operatively between the breaker and the crusher) for ripping up and loading purposes. Thus, the loader and/or the ripper can even be located behind the crusher so that the material flows through the crusher in a direction opposite to the general direction in which the equipment progresses. The true essence and spirit of this invention are defined in the appended claims, and it is not intended that the embodiment of the invention presented herein should limit the scope thereof.

What is claimed is:

1. A method for recycling a first lane of concrete pavement on a roadway having first and second adjacent lanes, the steps of the method comprising:

positioning an independently mobile machine for breaking concrete into rubble in one of said lanes for movement in a first direction;

positioning an independently mobile machine for crushing concrete rubble chunks into rubble pieces in said first lane operatively rearwardly of said machine for breaking concrete;

positioning an independently mobile machine for ripping up and cutting said rubble into rubble chunks operatively rearwardly of said machine for breaking concrete into rubble and operatively between said machine for breaking concrete and said machine for crushing concrete rubble chunks;

providing an independently mobile loading machine in one of the first and second lanes to raise and deliver said rubble chunks to said machine for crushing concrete without the loading machine departing from the roadway and without being connected to the machine for ripping up and cutting;

sequentially breaking concrete into rubble, ripping up and cutting said rubble into rubble chunks, and delivering said rubble chunks to said machine for crushing, and removing the crushed rubble pieces from said machine for crushing;

independently operating said machine for breaking concrete into rubble;

advancing and operating said machine for crushing concrete in the first direction behind said machine for breaking concrete and said machine for ripping up and cutting said rubble; and delivering said rubble chunks to said machine for crushing concrete, and maintaining said machine for crushing in said first lane as said machine for breaking concrete, said machine for crushing concrete rubble, said machine for ripping up and cutting said rubble into rubble chunks, and said loading machine are independently advanced along the roadway in said first direction.

* * * * *